US009810453B2

(12) United States Patent
Khoo

(10) Patent No.: US 9,810,453 B2
(45) Date of Patent: Nov. 7, 2017

(54) DEVICE FOR IMPROVING THE EFFICIENCY OF A HEAT EXCHANGE SYSTEM

(71) Applicant: Articmaster Inc., Las Vegas, NV (US)

(72) Inventor: Cass Khoo, Alameda, CA (US)

( * ) Notice: Subject to any disclaimer, the term of this patent is extended or adjusted under 35 U.S.C. 154(b) by 279 days.

(21) Appl. No.: 14/803,973

(22) Filed: Jul. 20, 2015

(65) Prior Publication Data

US 2016/0195310 A1 Jul. 7, 2016

Related U.S. Application Data

(60) Provisional application No. 62/099,991, filed on Jan. 5, 2015.

(51) Int. Cl.
*F25B 5/04* (2006.01)
*F25B 40/02* (2006.01)
*F25B 9/04* (2006.01)

(52) U.S. Cl.
CPC ..... *F25B 5/04* (2013.01); *F25B 40/02* (2013.01); *F25B 9/04* (2013.01); *F25B 2400/16* (2013.01); *F25B 2500/01* (2013.01)

(58) Field of Classification Search
CPC ..... F16L 26/0286; F16L 55/02718; F16L 55/02727; F16L 55/02745; F16L 55/0331; F16L 55/0332; F16L 55/02663; F25B 40/02; F25B 40/04; F25B 41/00; F25B 2339/0441; F25B 2500/12; F25B 43/003
USPC ..... 138/40–44; 428/188, 117; 62/511; 165/185
See application file for complete search history.

(56) References Cited

U.S. PATENT DOCUMENTS 2,694,296 A * 11/1954 Prosek ..... F25B 41/06 138/44
5,875,651 A * 3/1999 Hill ..... F25B 41/06 138/44
2007/0245761 A1* 10/2007 Lee ..... C22C 1/08 62/296
2010/0139885 A1* 6/2010 Hoffman ..... F02G 1/057 165/7
2011/0083835 A1* 4/2011 Chen ..... F28D 15/046 165/185

* cited by examiner

*Primary Examiner* — Cassey D Bauer
(74) *Attorney, Agent, or Firm* — Sumana Prabhu

(57) ABSTRACT

In one aspect of the invention, an apparatus for improving the efficiency of a heat exchange system having a compressor, condenser, expansion valve, evaporator and a flowing refrigerant is provided. The apparatus is a tubular device having a refrigerant entrance and a refrigerant exit and is positioned in the heat exchange system between the expansion valve and the evaporator. The device further comprises a means for removing heat from the refrigerant. According to an embodiment of the invention, the heat removal means is a cylindrical screen coated with diamonds.

8 Claims, 5 Drawing Sheets

DEVICE FOR IMPROVING THE EFFICIENCY OF A HEAT EXCHANGE SYSTEM

CROSS-REFERENCE TO RELATED APPLICATION

This patent application claims the priority benefit under 35 U.S.C. §119(e) of U.S. Provisional Application No. 62/099,991 filed on Jan. 5, 2015, the contents of which are herein incorporated by reference.

FIELD OF THE INVENTION

The present invention relates generally to heat exchange systems and particularly to refrigeration and air conditioning devices. More specifically, the inventive device is designed with heat dissipating capability that achieves maximum refrigerant operational conditions while reducing energy consumption by the system.

BACKGROUND OF THE INVENTION

A typical refrigeration system has four basis components: a compressor, a condenser (heat exchanger), an evaporator (heat exchanger) an expansion valve and the necessary plumbing to securely connect the components. These components are essentially the same regardless of the size of the system. The refrigerant to begin with, is in a gaseous state and compressed in a compressor so as to produce high pressures and temperatures. When the gas temperature/pressure in the compressor is greater than that of the condenser, gas will move from the compressor to the condenser. In the condenser, the refrigerant vapor is liquified and then transported to the expansion valve which permits the liquid refrigerant to expand slowly into the evaporator. After evaporating into its gaseous form, the gaseous refrigerant is moved to the compressor to repeat the cycle.

The refrigerant that enters the expansion valve from the condenser is generally in 100% liquid form at a high temperature of approximately 105 deg C. (corresponding to a pressure of 278 psig). Once it passes through the expansion valve, the temperature drops drastically (to about 41 deg F.). The sudden drop in temperature causes the boiling point or saturation temperature of the liquid refrigerant to drop. Hence some of the liquid boils off and flashes into vapor (flash gas). The refrigerant entering the evaporator is therefore partially in liquid form with only a small vapor fraction. The liquid in the evaporator is in an adiabatic state and therefore cannot absorb or reject heat. Only when liquid changes to the vapor state, the refrigerant can absorb heat from the warmer environment that needs to be cooled.

For efficient heat transfer through the evaporator coil, it would be beneficial to utilize as much of the evaporator coil area as possible. But the inefficient flow rate through the evaporator leads to inefficient cooling and build-up of frost or ice especially in the initial lower portion of the coil, leading to poor heat conduction through the evaporator coil and inefficient cooling. The present invention seeks to overcome this problem by providing an apparatus designed to enhance the heat transfer efficiency of the refrigerant mixture by feeding the evaporator with a refrigerant mixture that has a higher vapor content than a normal refrigeration system.

BRIEF SUMMARY OF THE INVENTION

In one aspect of the invention, an apparatus (or device) for improving the efficiency of a heat exchange system having a compressor, condenser, expansion valve, evaporator and a flowing refrigerant is provided. The apparatus comprises a tubular device having a refrigerant entrance and a refrigerant exit, said device positioned in the heat exchange system between the expansion valve and the evaporator and a means associated with said device for removing heat from the refrigerant. According to an embodiment of the invention, the tubular device comprises an outer pipe having a first open end and a second open end with the heat removal means positioned inside said outer pipe, a first inner pipe passing through the first open end of said outer pipe and a second inner pipe passing through the second open end of said outer pipe, wherein the first inner pipe and the second inner pipe are in contact with the heat removal means. Preferably, heat removal means comprises a cylindrical screen coated with diamonds.

Another aspect of the invention is a method of fabricating an efficiency-enhancing apparatus for use in a heat exchange system positioned between the expansion valve and the evaporator of the system, said method comprising the steps of providing an outer pipe having a first open end and a second open end, positioning a heat removal means within said outer pipe, inserting a first inner pipe through the first open end of said outer pipe, inserting a second inner pipe through the second open end of said outer pipe, wherein the first and second inner pipes are in contact with the heat removal means. Preferably, heat removal means comprises a cylindrical screen coated with diamonds.

In another aspect of the invention, a heat exchange system with improved efficiency having a compressor, condenser, evaporator, an expansion valve and a circulating refrigerant is provided. The system comprises an efficiency enhancing apparatus positioned between the expansion valve and the evaporator and means associated with the apparatus to remove heat from the refrigerant. The apparatus comprises a tubular device having a refrigerant entrance and a refrigerant exit and a means associated with said device for removing heat from the refrigerant. According to an embodiment of the invention, the tubular device comprises an outer pipe having a first open end and a second open end with the heat removal means positioned inside said outer pipe, a first inner pipe passing through the first open end of said outer pipe and a second inner pipe passing through the second open end of said outer pipe, wherein the first inner pipe and the second inner pipe are in contact with the heat removal means. In one embodiment the heat removing means comprises a cylindrical screen coated with diamonds.

In yet another aspect of the invention, a heat exchange system with improved efficiency having a compressor, condenser, evaporator, an expansion valve and a circulating refrigerant is provided, said system comprising a tubular device having a refrigerant entrance and a refrigerant exit and positioned in the heat exchange system between the expansion valve and the evaporator and further, a means associated with said device for removing heat from the refrigerant. The heat exchange system further comprises a sub cooling device positioned between the expansion valve and the evaporator.

According to an embodiment of the invention, the tubular device comprises an outer pipe having a first open end and a second open end with the heat removal means positioned inside said outer pipe, a first inner pipe passing through the first open end of said outer pipe and a second inner pipe passing through the second open end of said outer pipe, wherein the first inner pipe and the second inner pipe are in contact with the heat removal means. In one embodiment, the heat removing means comprises a cylindrical screen coated with diamonds.

In one embodiment the sub cooling device comprises a vessel which stores a portion of the circulating liquid refrigerant from the condenser and comprises a refrigerant entrance and a refrigerant exit, a first means for creating turbulence at the refrigerant entrance, a second means for creating turbulence at the refrigerant exit and a bypass path from the refrigerant entrance to sub-cool a portion of the liquid refrigerant entering the vessel. The refrigerant bypass path comprises a bypass tube extending into the center of the vessel. The bypass tube terminates in at least one bypass exit port. In an embodiment of the invention, the first means for creating turbulence comprises a disk located proximate said refrigerant entrance, wherein the disk permits the passage for the entering refrigerant into the bottom of the vessel; and wherein the second means for creating turbulence comprises a disk located proximate the refrigerant exit, the disk permitting the passage of exiting refrigerant. Further, at least one fixed angle blade is formed in the disk, wherein the blade adds turbulence to the exiting refrigerant. The second means comprises three fixed angle blades formed in the disc.

In another aspect of the invention, a heat exchange system with improved efficiency having a compressor, condenser, evaporator, an expansion valve and a circulating refrigerant is provided, said system comprising a tubular device having a refrigerant entrance and a refrigerant exit and positioned in the heat exchange system between the expansion valve and the evaporator and further a means associated with said device for removing heat from the refrigerant. The heat exchange system further comprises an efficiency enhancing apparatus (herein referred to as 'auxiliary passive condenser) positioned between the expansion valve and the evaporator.

According to an embodiment of the invention, the tubular device comprises an outer pipe having a first open end and a second open end with the heat removal means positioned inside said outer pipe, a first inner pipe passing through the first open end of said outer pipe and a second inner pipe passing through the second open end of said outer pipe, wherein the first inner pipe and the second inner pipe are in contact with the heat removal means. In one embodiment the heat removing means comprises a cylindrical screen coated with diamonds.

In an embodiment of the invention, the auxiliary passive condenser comprises a chamber having a refrigerant entry port and a refrigerant exit port and a down tube passing through the center of said chamber and through the exit port wherein the down tube includes holes to permit the passage of refrigerant from the chamber into the down tube. Preferably the down tube comprises at least three holes. Further, the down tube comprises a top inlet port and a bottom outlet port. wherein the ratio of the diameter of the inlet port to the outlet port is greater than 1. The top inlet port is sealed with an expansion screen wherein said expansion screen is a mesh comprising copper, aluminum or a copper-based alloy.

In another aspect of the invention, a method of improving the heat transfer efficiency of a heat exchange system comprising a compressor, condenser, evaporator, an expansion valve and a circulating refrigerant is provided, said method comprising the steps of: compressing a refrigerant in said compressor, passing said refrigerant through a condenser; allowing the refrigerant exiting said condenser to flow through said expansion valve and into a tubular device; wherein said tubular device comprises a means to remove heat from said refrigerant.

According to an embodiment of the invention, the tubular device comprises an outer pipe having a first open end and a second open end with the heat removal means positioned inside said outer pipe, a first inner pipe passing through the first open end of said outer pipe and a second inner pipe passing through the second open end of said outer pipe, wherein the first inner pipe and the second inner pipe are in contact with the heat removal means. In one embodiment, the heat removing means comprises a cylindrical screen coated with diamonds.

Other novel features which are characteristic of the invention, as to organization and method of operation, together with further objects and advantages thereof will be better understood from the following description considered in connection with the accompanying drawings, in which preferred embodiments of the invention are illustrated by way of example. It is to be expressly understood, however, that the drawings are for illustration and description only and are not intended as a definition of the limits of the invention. The various features of novelty which characterize the invention are pointed out with particularity in the claims annexed to and forming part of this disclosure. The invention resides not in any one of these features taken alone, but rather in the particular combination of all of its structures for the functions specified.

BRIEF DESCRIPTION OF THE DRAWINGS

The invention will be better understood and objects other than those set forth above will become apparent when consideration is given to the following detailed description thereof. Such description makes reference to the annexed drawings wherein.

DETAILED DESCRIPTION OF THE INVENTION

Figure 1:
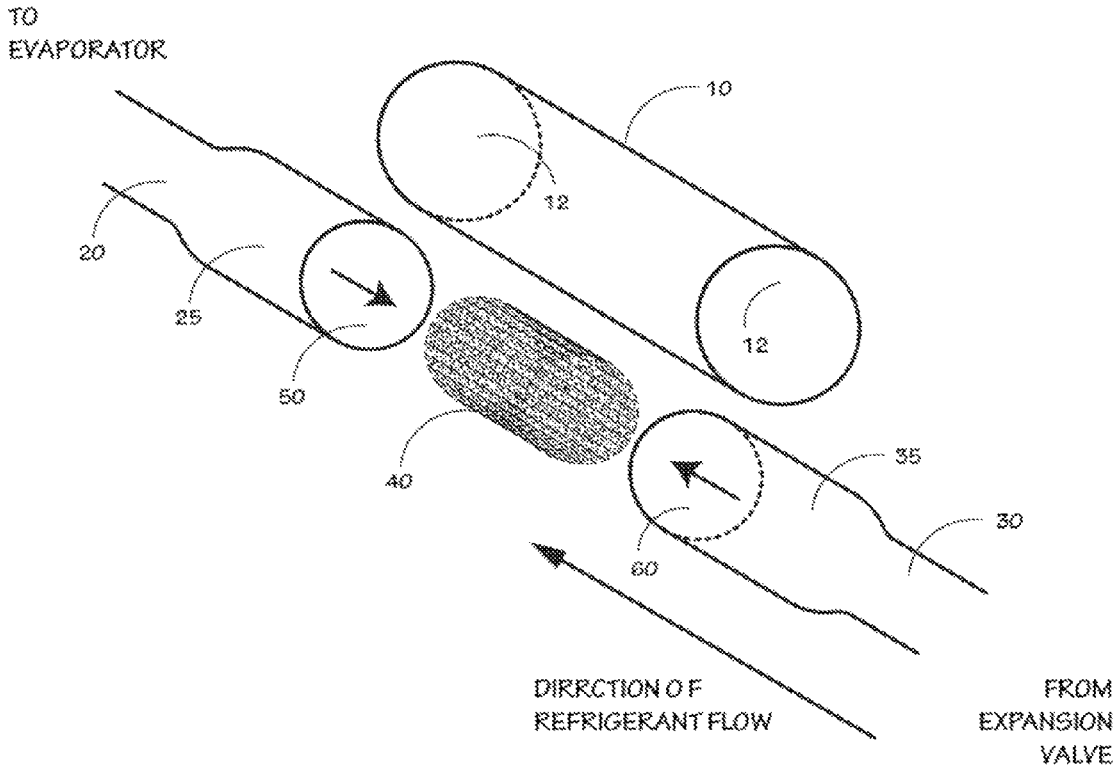
FIG. 1 shows the apparatus of the invention with the various parts including the inner tubes, the cylindrical screen and the outer tube.

By way of introduction to the environment in which the inventive system operates, the following is a brief description of the functioning of a traditional refrigeration system.

Various devices relying on standard refrigerant recycling technologies have been available for many years, such as refrigeration and heat pump devices, having both cooling and heating capabilities. Within the limits of each associated design specification, heat pump devices enable a user to cool or heat a selected environment or with a refrigeration unit to cool a desired location. For these heating and cooling duties, in general, gases or liquids are compressed, expanded, heated, or cooled within an essentially closed system to produce a desired temperature result in the selected environment.

An expandable-compressible refrigerant is contained and cycled within an essentially enclosed system comprised of various refrigerant manipulating components. When a liquid refrigerant expands (within a heat exchanger or evaporator) to produce a gas it increases its heat content at the expense of a first surrounding environment which decreases in temperature. The heat rich refrigerant is transported to a second surrounding environment and the heat content of the expanded refrigerant released to the second surroundings via condensation (within a heat exchanger or condenser), thereby increasing the temperature of the second surrounding environment. As indicated, even though the subject invention is used preferably with a refrigeration system, adaptation to a generalized heat pump system is also contemplated. Therefore, for a heat pump, heating or cooling conditions are generated in the first and second environments by reversing the process within the enclosed system.

A lower compression ratio reflects a higher system efficiency and consumes less energy during operation. During compression the refrigerant gas pressure increases and the refrigerant gas temperature increases. When the gas temperature/pressure of the compressor is greater than that of the condenser, gas will move from the compressor to the condenser. The amount of compression necessary to move the refrigerant gas through the compressor is called the compression ratio. The higher the gas temperature/pressure on the condenser side of the compressor, the greater the compression ratio. The greater the compression ratio the higher the energy consumption. Further, the energy (KW) necessary to operate a cooling or heat exchange system is primarily determined by three factors: the compressor's compression ratio; the refrigerant's condensing temperature; and the refrigerant's flow characteristics.

The compression ratio is determined by dividing the discharge pressure (head) by the suction pressure. Any change in either suction or discharge pressure will change the compression ratio.

It is noted that for refrigeration systems or any heat pump system when pressure calculations are performed they are often made employing absolute pressure units (PSIA), however, since most individuals skilled in the art of heat pump technologies are more familiar with gauge pressure (PSIG), gauge pressures are used as the primary pressure units in the following exemplary calculations. In a traditional refrigeration system, a typical discharge pressure is 226 PSIG (241 PSIA) and a typical suction pressure is 68 PSIG (83 PSIA). Dividing 226 PSIG by 68 PSIG yields a compression ratio of about 2.9.

The condensing temperature is the temperature at which the refrigerant gas will condense to a liquid, at a given pressure. Well known standard tables relate this data, in a traditional example, using R22 refrigerant, that pressure is 226 PSIG. This produces a condensing temperature of 110 degrees F. At 110 degrees F., each pound of liquid freon that passes into the evaporator will absorb 70.052 Btu's. However, at 90 degrees F. each pound of freon will absorb 75.461 Btu's. Thus, the lower the temperature of the liquid refrigerant entering the evaporator the greater its ability to absorb heat. Each degree that the liquid refrigerant is lowered increases the capacity of the system by about one-half percent.

Well known standard tables of data that relate the temperature of a liquid refrigerant to the power required to move Btu's per hour show that if the liquid refrigerant is at 120 degrees F., 0.98 hp will move 22873 Btu's per hour. If the liquid refrigerant is cooled to 60 degrees F., only 0.2 hp is required to move 29563 Btu's per hour.

FIG. 1 shows the apparatus of an embodiment of the invention. A cylindrical screen 40 is coated on the inside with diamonds. The screen is placed inside a copper connector tube 10, where it is held together by two copper tubes 25 and 35. Preferably, the upper ends of the copper tubes have a smaller diameter, 20 and 30 as shown in the FIG. 1. Since the tubes have a narrower opening at the outer ends, the screen is confined well within the tubes.

Preferably, the cylindrical screen is fabricated from a flat copper or aluminum screen with appropriate dimensions so as to fit inside the tubes when rolled into a cylinder. Epoxy glue is applied on the flat screen which is then placed on industrial diamonds so that the diamonds are glued onto the screen. The screen is then removed and the diamond pieces are allowed to dry and harden. Excess diamond may be dusted with a wire brush. The screen is then rolled into a cylinder having a diameter that corresponds to the inner diameter of the copper tubes and the length of the cylinder is not more than the length of the outer connector tube.

Figure 2:
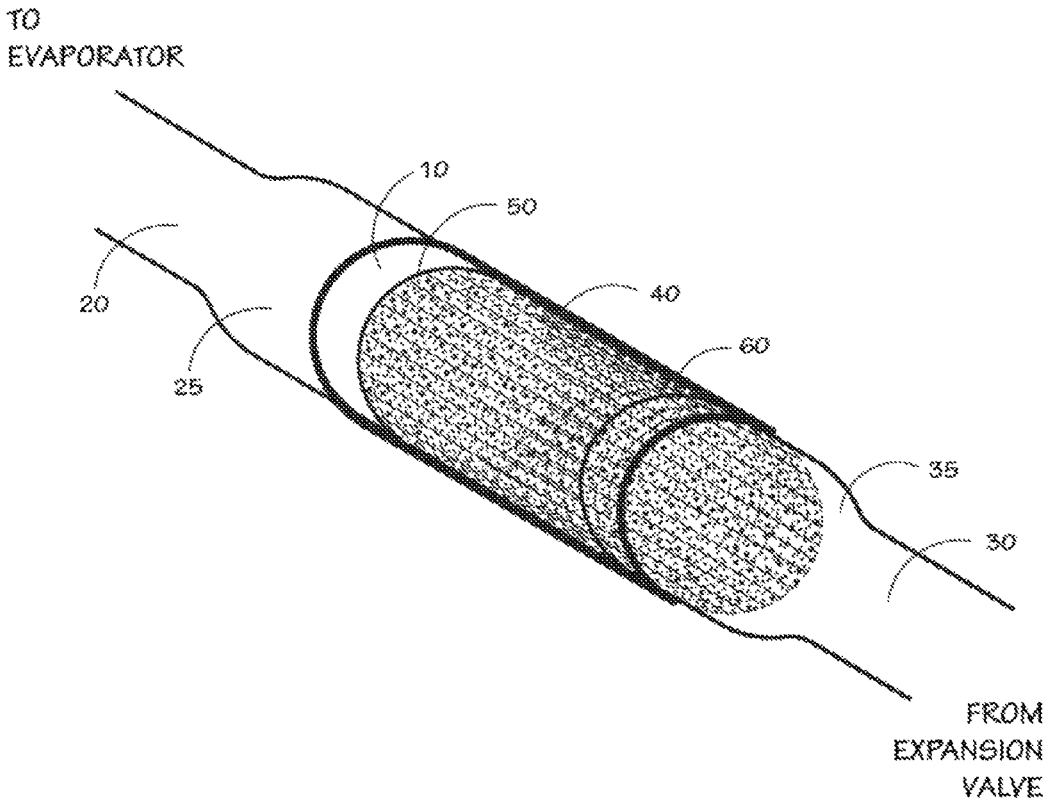
FIG. 2 shows the apparatus with the various parts fully assembled.

Referring now to FIG. 2, the various parts of the device are shown fully assembled. The apparatus comprises two copper pipes 20 and 30, the cylindrical screen, 40 and an outer connector pipe 10. As can be seen, the length of the screen is not more than the length of the outer connector tube. The screen is first positioned inside the connector pipe as shown. Two copper pipes are then inserted through the open ends of the connector pipe with the screen centrally located between the two pipes. The screen is therefore held snugly within the pipes. The diameter of the two inner pipes are slightly smaller than that of the connector pipe so that their surfaces touch and there is no space between outer connector pipe and the two inner pipes which are in contact with the cylindrical screen.

The refrigerant that enters the expansion valve passes through a copper screen filled with diamonds before flowing into the evaporator. In this case, the temperature is reduced due to heat exchange with the diamonds and hence heat or energy transfer occurs. The flow area for the refrigerant is the internal area of the inner copper tubes since the cylindrical screen is in contact with the tubes. The turbulence of hitting the diamonds and the screen, breaks up the refrigerant and the heat transfer ability of the diamonds helps dissipate the heat from the refrigerant to the outside, making it cooler on the inside as the refrigerant passes.

Further, the improved heat transfer due to the high conductivity of diamonds reduces the build up of ice in the evaporator coils especially in the initial portions of the evaporator coil. The contact area of the screen assists in the vaporization of the refrigerant leaving the expansion device so that the refrigerant mixture entering the evaporator has a higher vapor content as compared to the prior art systems thus improving the efficiency of the heat exchange system.

In some implementations of the invention the size and diameter of the copper tube as well as the dimensions of the cylinder screen may be varied. Other implementations include variations in size of diamonds and their density and variable ratio of cylinder to copper tube diameter.

Figure 3:
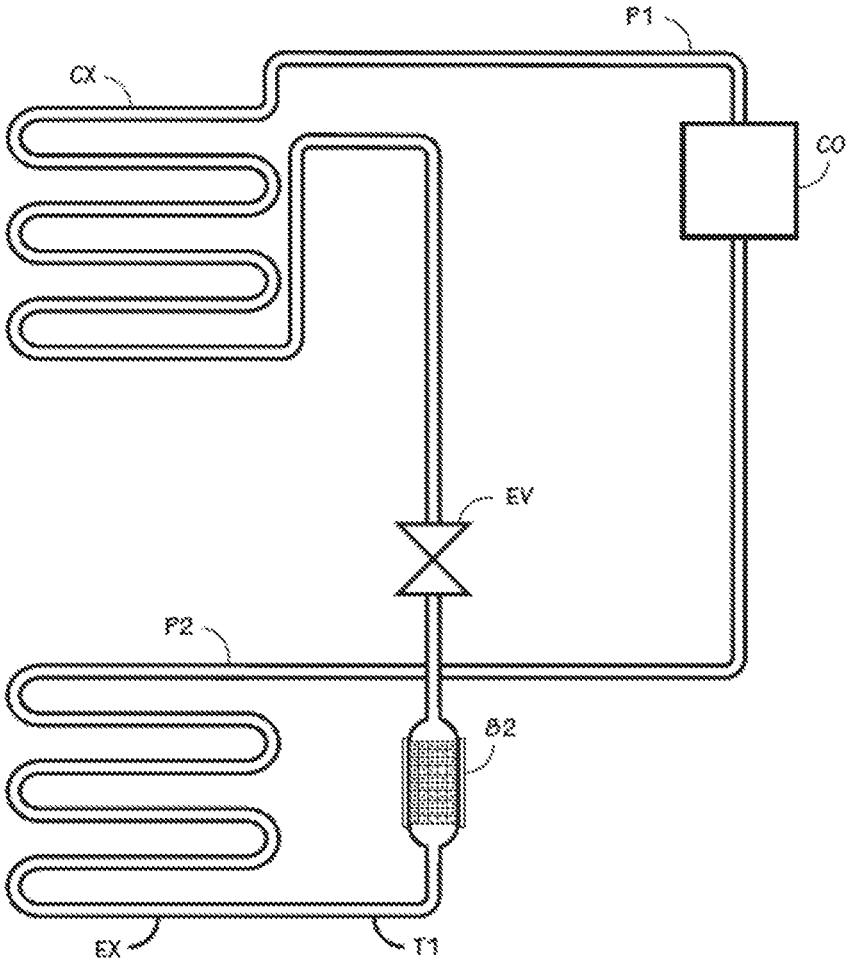
FIG. 3 shows the heat exchange system with the inventive apparatus positioned between the expansion valve and the evaporator.

FIG. 3 shows a refrigeration/heat exchange system. Components of the system include a compressor CO, condenser CX, evaporator EX, and an expansion valve EV. The inventive apparatus, 82 is positioned between the expansion valve and the evaporator of the heat exchange system. The system efficiency of about 8-15% is achieved.

The efficiency of the system may further be enhanced to more than 20%, by introducing a sub cooling device or an auxiliary passive condenser between the condenser and the evaporator details of which are discussed below with reference to FIGS. 4 and 5.

Figure 4:
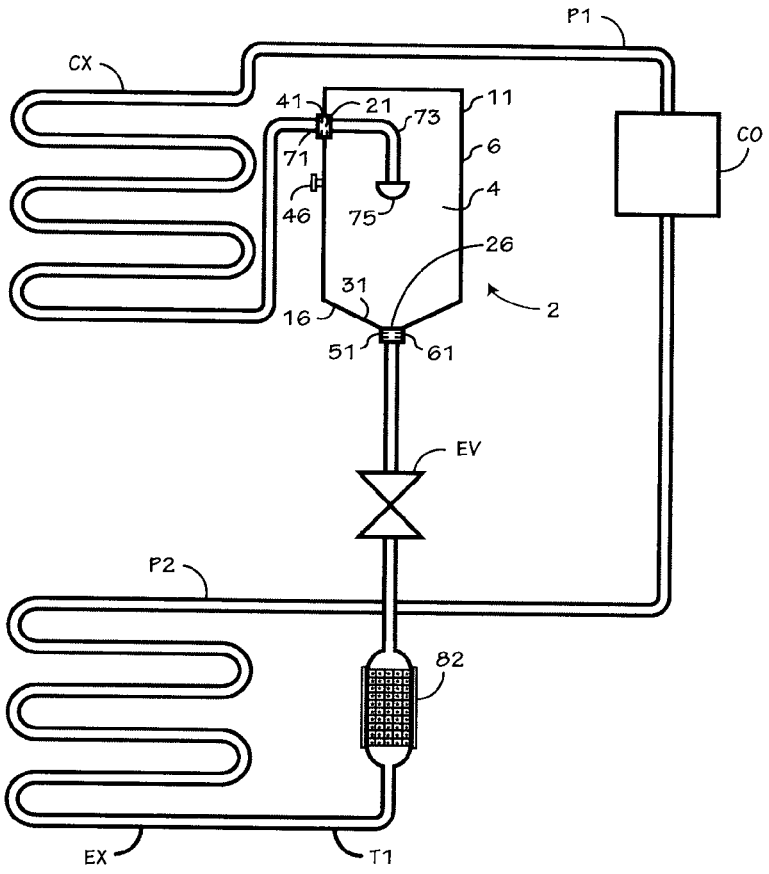
FIG. 4 shows the heat exchange system with a sub cooling device positioned between the condenser and the evaporator.

Referring now to FIG. 4, there is shown a schematic view of a refrigeration system which includes a sub cooling device fitted into the system between the condenser CX and the expansion valve EV. The system stores excess liquid refrigerant (that is normally stored in the condenser) in a holding vessel 2, thus giving an increased condensing volume (usually approximately 20% more condensing volume), thereby cooling the refrigerant more (a type of sub-cooling). By adding this extra cooling, the system reduces the discharge pressure and suction pressure. For discharge at P1 the pressure is 168 PSIG (183 PSIA) and for suction at P2 the pressure is 60 PSIG (74 PSIA). With these discharge and suction pressures, the compression ratio calculates to be 2.5. For the traditional refrigeration system, the previously calculated compression ratio was 2.9. This shows a reduction in compression work of about 17%.

A liquid refrigerant entrance 21 and a liquid refrigerant exit 26 penetrate the vessel 2. Preferably, the refrigerant entrance 21 is located in a top region of the vessel 2. The top region is defined as being approximately between a midline of the cylinder 6, bisecting the cylinder 6 into two smaller cylinders, and the top end cap 11. Although FIG. 4 depicts the refrigerant entrance 21 as penetrating the cylinder 6, the entrance may penetrate the top end cap 11. Preferably, the refrigerant exit 26 is located in a bottom region of the vessel 2. The bottom region of the vessel 2 is defined as being approximately between the midline, above, and the bottom end cap 16. Although other locations are possible, the refrigerant exit 26 is preferably located proximate the center of the bottom end cap 16.

Usually, the bottom end cap 16 has an angled or sloping interior surface 31. However, the bottom end cap 16 may have an interior surface of other suitable configurations, including being flat.

Liquid refrigerant liquefied by the condenser CX enters into the vessel 2 via the refrigerant entrance 21 and the associated components. The associated entrance components comprises entrance fitting 41 that secures the vessel 2 into the exit portion of the plumbing coming from the condenser CX. The entrance fitting 41 is any suitable means that couples the subject device into the pluming in the required position between the condenser CX and the expansion valve EV.

A disk 71 positioned at the liquid refrigerant entrance 21 may include an aperture connected to a bypass tube 73 extending into the center of the vessel, which terminates in at least one bypass exit port 75, thereby reintroducing the bypass refrigerant to the rest of the refrigerant stream at the bottom of the vessel.

To view the level of the liquid refrigerant within the vessel 2, a sight glass 46 is provided. The glass 46 is mounted in the cylinder 6 at a position to note the refrigerant level.

The refrigerant exit 26 is comprised of an exit tube and fitting 51 that secures the subject device into the plumbing of the system. The exit fitting 51 is any suitable means that couples the subject device into the plumbing in the required position between the condenser CX and the expansion valve EV.

A second means for introducing a turbulent flow into the exiting liquefied refrigerant is mounted proximate the exit 26. A "turbulator" 61 is held in place by cooperation between the exit tube and fitting 51 or any other equivalent means. The turbulator is usually a separate component that is secured within the components of the exit from the vessel 2, however, the turbulator may be an integral part of the vessel 2 refrigerant exit. The turbulator comprises a disk with a central aperture and at least one fixed angle blade formed or cut into the disk. Preferably, a set of fixed angle blades are provided to add turbulence to the exiting refrigerant.

The blades are angled to induce rotational, turbulent motion of the liquid refrigerant as the refrigerant exits the vessel 2. Various angles for the blades are suitable for generating the required turbulence.

Preferably, the subject vessel 2 is placed in the adapted system so that the refrigerant exit 26 is no lower than the lowest portion of the condenser CX. Liquid refrigerant from the condenser CX enters the vessel 2 and is directed into the interior volume 4. The refrigerant leaves the vessel 2 by means of the refrigerant exit 26 and then encounters the turbulator 61. The blades of the turbulator 61 add additional turbulence into the flow of the refrigerant.

After the refrigerant enters the vessel and starts to exit, it develops a shallow-well vortex at the bottom of the vessel 2. In the center of the shallow-well vortex, it develops a low-pressure area. The stronger the vortex, which increases as it becomes hotter, the greater the low-pressure area in the center of the vortex, thereby being able to sub-cool the refrigerant that exits bottom of the bypass tube 75.

With the development of the low-pressure area in the center of the vortex, the small amount of refrigerant entering the bypass path at the liquid refrigerant entrance 21 expands and comes out at the bypass path exit port 75 to sub-cool the refrigerant and allow the heat bubbles carried by the refrigerant to continue to condense so as to allow the refrigerant that is delivered downstream to the expansion valve to have less non-condensed refrigerant within it, thereby improving the operation of the system.

In a preferred embodiment, the disk 71 positioned at the liquid refrigerant entrance 21 comprises an incremental expansion device disk. The disk develops a low pressure area on the back side and creates a turbulent flow of refrigerant entering the vessel, thereby improving refrigerant efficiency. The disk may be such as was disclosed above as turbulator 61 at the refrigerant exit; or disclosed in the heat pump efficiency enhancer of U.S. Pat. No. 5,259,213 (e.g., FIG. 4, valve plate 160 of that disclosure); or any other disk configuration that develops a low pressure area on the back side and creates a turbulent flow of refrigerant, which can be incorporated into the refrigerant entrance 21 of the vessel.

Figure 5:
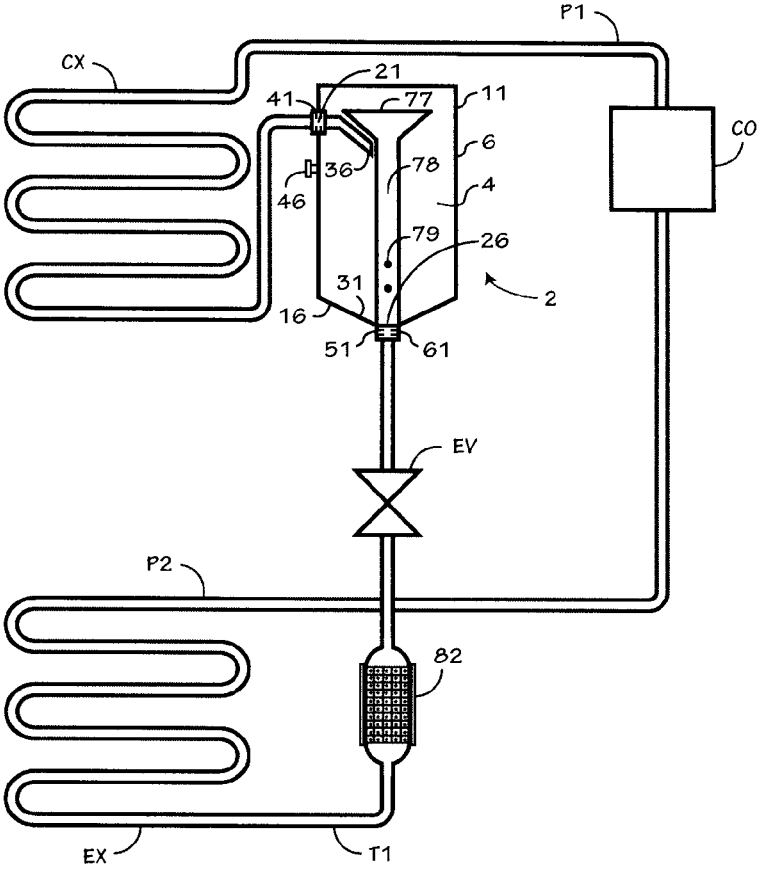
FIG. 5 shows the heat exchange system comprising the auxiliary passive condenser positioned between the condenser and the evaporator.

Referring now to FIG. 5, there is shown a schematic view of a refrigeration system which includes an auxiliary passive condenser fitted into the system between the condenser CX and the evaporator and before the expansion valve. This helps to condense and thereby sub-cool a portion of the refrigerant within the chamber 2. The auxiliary passive condenser is preferably fabricated from a cylinder 6 and top 11 and bottom 16 end caps of suitable material such a metal, metal alloy, or natural or synthetic polymers. Generally the top 11 and bottom 16 end caps are secured to the cylinder 6 by appropriate means such as soldering, welding, brazing, gluing, threading and the like, however, the entire chamber may be formed from a single unit with the cylinder 6 and top 11 and bottom 16 end caps as a unitized construction.

A liquid refrigerant entrance 21 and a liquid refrigerant exit 26 penetrate the passive condenser. Preferably, the refrigerant entrance 21 is located in a top region of the chamber 2. The top region is defined as being approximately between a midline of the cylinder 6, bisecting the cylinder 6 into two smaller cylinders, and the top end cap 11. Preferably, the refrigerant exit 26 is located in a bottom region of the chamber 2. The bottom region of the chamber 2 is defined as being approximately between the midline, above, and the bottom end cap 16. Although other locations are possible, the refrigerant exit 26 is preferably located proximate the center of the bottom end cap 16. The bottom end cap 16 has an angled or sloping interior surface 31. However, the bottom end cap 16 may have an interior surface of other suitable configurations, including being flat.

Liquid refrigerant liquefied by the condenser CX enters into the chamber 2 via the refrigerant entrance 21 and the associated components. The associated entrance components comprise an entrance fitting 41 that secures the chamber 1 into the exit portion of the plumbing coming from the condenser CX. The entrance fitting 41 is any suitable means that couples the subject device into the plumbing in the required position between the condenser CX and the evaporator EX.

To view the level of the liquid refrigerant within the chamber 2, a sight glass 46 is provided. The glass 46 is mounted in the cylinder 6 at a position to note the refrigerant level.

In the center of the passive condenser is a down tube 78 with an inlet 77 at the top surface and an outlet at the bottom that passes through the exit fitting, 51. Preferably, the inlet 77 has a width that is greater than the rest of the tube so that the tube is almost shaped like a funnel. The inlet is further sealed with a vapor tube expansion screen such as a mesh/sieve. Preferably, the mesh size varies between 10 microns to 50 microns and could be made from copper, aluminum or any alloy containing copper. However, depending on the thickness of the down tube, the mesh size can vary beyond this range. Liquid refrigerant from the condenser CX enters the auxiliary passive condenser and flows to the bottom of the unit, filling up to almost one-third of the volume of the unit. At least three holes 79, are located in the lower portion of the down tube. Preferably the holes are positioned in the lower region at about less than one fourth the height of the cylinder. The condensed liquid refrigerant that flows into the passive condenser, passes through the holes and into the down tube. The size of the holes are designed so that almost half the length of the down tube is filled with the refrigerant liquid before draining at the bottom 61, thereby creating a vortex to the exit, and around the down tube.

The suction of the refrigerant through the holes 79 at the bottom of the down tube creates a vacuum inside the tube. As a result, the non-condensed refrigerant is drawn towards the top inlet of the down tube 77 past the vapor tube expansion screen, raising the non-condensed refrigerant up further and allowing for further cooling within the chamber. When the refrigerant eventually exits the passive condenser, it is considerable cooler than when it entered the vessel, making the entire refrigeration system more efficient. This cooling state can be greatly improved with a vortex flow as well as increasing the inlet and outlet line size, to coincide with the size of the refrigeration unit.

Preferably, the auxiliary passive condenser is placed in the adapted system so that the refrigerant exit 26 is no lower than the lowest portion of the condenser CX. The refrigerant exit 26 is comprised of an exit tube and fitting 51 that secures the subject device into the plumbing of the system. The exit fitting 51 is any suitable means that couples the subject device into the plumbing in the required position between the condenser CX and the evaporator EX.

In some implementations of the invention, the return line which is the down tube may be enlarged in order to get more suction. Other implementations include increasing the ratio of size of the inlet to the size of the outlet pipe to enhance the refrigerant flow. This gives more low pressure as needed for adequate cooling of the refrigerant within the secondary condenser or supplementary (auxiliary) passive condenser.

With the development of the low pressure area, the small amount of refrigerant entering the holes at the lower end of the down tube create a vacuum and allow the heat bubbles carried by the refrigerant to continue to condense so as to allow the refrigerant that is delivered downstream to the expansion valve to have less non-condensed refrigerant within it, thereby improving the operation of the system.

There has thus been broadly outlined the more important features of the invention in order that the detailed description thereof that follows may be better understood, and in order that the present contribution to the art may be better appreciated. There are, of course, additional features of the invention that will be described hereinafter and which will form additional subject matter of the claims appended hereto. Those skilled in the art will appreciate that the conception upon which this disclosure is based readily may be utilized as a basis for the designing of other structures, methods and systems for carrying out the several purposes of the present invention. It is important, therefore, that the claims be regarded as including such equivalent constructions insofar as they do not depart from the spirit and scope of the present invention.

I claim:

1. A heat exchange system with improved efficiency having a compressor, condenser, evaporator, an expansion valve and a circulating refrigerant said system comprising:
- an tubular device having a refrigerant entrance and a refrigerant exit,
- said device positioned between the expansion valve and the evaporator; and
- means associated with said device to remove heat from the refrigerant.

2. The heat exchange system of claim 1, wherein said device comprises an outer pipe having a first open end and a second open end, with the heat removal means positioned inside said outer pipe.

3. The heat exchange system of claim 2, wherein said device further comprises:
- a first inner pipe passing through the first open end of said outer pipe; and
- a second inner pipe passing through the second open end of said outer pipe;
- wherein the first inner pipe and the second inner pipe are in contact with the heat removal means.

4. The heat exchange system of claim 3, wherein said means comprises a cylindrical screen coated with diamonds.

5. A method of improving the heat transfer efficiency of a heat exchange system comprising a compressor, condenser, evaporator, an expansion valve and a circulating refrigerant, said method comprising the steps of:
- compressing a refrigerant in said compressor;
- passing said refrigerant in said compressor;
- allowing the refrigerant exiting said condenser to flow said expansion valve and into a tubular device;
- wherein said tubular device comprises a means to remove heat from said refrigerant.

6. The method of claim 5, wherein said tubular device comprises an outer pipe having a first open end and a second open end with the heat removal means positioned inside said outer pipe.

7. The method of claim 6, wherein said device further comprises:
- a first inner pipe passing through the first open end of said outer pipe; and
- a second inner pipe passing through the second open end of said outer pipe;

wherein the first inner pipe and the second inner pipe are in contact with the heat removal means.

8. The method of claim 7, wherein said heat removal means comprises a cylindrical screen coated with diamonds.

* * * * *